US007837131B2

(12) United States Patent
Huffman et al.

(10) Patent No.: US 7,837,131 B2
(45) Date of Patent: Nov. 23, 2010

(54) MODULAR AUTOMATIC SPRAY GUN MANIFOLD

(75) Inventors: David C. Huffman, Merrimack, NH (US); Russell R. Frechette, Pelham, NH (US)

(73) Assignee: Spraying Systems Co., Wheaton, IL (US)

( * ) Notice: Subject to any disclaimer, the term of this patent is extended or adjusted under 35 U.S.C. 154(b) by 162 days.

(21) Appl. No.: 11/496,205

(22) Filed: Jul. 31, 2006

(65) Prior Publication Data

US 2007/0029411 A1 Feb. 8, 2007

Related U.S. Application Data

(63) Continuation-in-part of application No. 10/810,997, filed on Mar. 26, 2004, now Pat. No. 7,083,121.

(60) Provisional application No. 60/457,946, filed on Mar. 27, 2003.

(51) Int. Cl.
*B05B 1/24* (2006.01)

(52) U.S. Cl. ..... 239/139; 239/133

(58) Field of Classification Search ..... 239/139, 239/548, 550, 553.5, 566, 132.1, 128, 124, 239/125, 149.5, 428.5, 291, 292, 133
See application file for complete search history.

(56) References Cited

U.S. PATENT DOCUMENTS 3,219,274 A * 11/1965 Roche ..... 239/133
3,827,637 A 8/1974 Stephany et al.
4,257,559 A 3/1981 Noren
4,760,961 A 8/1988 Nagai
5,108,034 A * 4/1992 Huey et al. ..... 239/13

(Continued)

FOREIGN PATENT DOCUMENTS

DE 19700874 A1 7/1998

(Continued)

*Primary Examiner*—Davis Hwu
(74) *Attorney, Agent, or Firm*—Leydig, Voit & Mayer, Ltd.

(57) ABSTRACT

A modular automatic spray gun manifold is provided. The manifold includes a plurality of spray gun modules arranged in an array in laterally spaced relation from each other. A junction element is arranged at an upstream end of the manifold for introducing fluid into the manifold. A first support assembly is arranged between the junction element and a first spray gun module in the spray gun module array for supporting the first spray gun module relative to the junction element. The first support assembly includes a plurality of fluid conduits for supplying fluid to the first spray gun module. One or more second support assemblies with one second support assembly are arranged between each adjacent pair of spray gun modules in the array of spray gun modules for supporting the adjacent pair of spray gun modules relative to each other. Each second support assembly includes a plurality of fluid conduits for communicating fluid between the adjacent spray gun modules such that fluid introduced into the manifold through the junction element is communicated to each spray gun module. The first support assembly and each second support assembly include an interior space through which their respective plurality of fluid conduits extend and a heat transfer fluid inlet for communicating a hot heat transfer fluid into the interior space of the respective support assembly.

23 Claims, 12 Drawing Sheets

U.S. PATENT DOCUMENTS 5,154,356 A 10/1992 Sorenson
5,170,941 A * 12/1992 Morita et al. ..... 239/416.4
5,565,241 A * 10/1996 Mathias et al. ..... 427/196
5,707,010 A 1/1998 Manfre et al.
5,740,970 A 4/1998 Edwards
5,862,987 A 1/1999 Reif
6,182,908 B1 * 2/2001 Hamilton ..... 239/125
6,491,756 B1 12/2002 Platsch et al.
2002/0139300 A1 10/2002 Wlodarczyk

FOREIGN PATENT DOCUMENTS

DE 202006005923 U1 8/2007

* cited by examiner

MODULAR AUTOMATIC SPRAY GUN MANIFOLD

CROSS-REFERENCE TO RELATED APPLICATIONS

This patent application is a continuation-in-part of U.S. patent application Ser. No. 10/810,997, filed Mar. 26, 2004, which claims the benefit of U.S. Provisional Patent Application No. 60/457,946, filed Mar. 27, 2003.

FIELD OF THE INVENTION

The present invention relates generally to spray gun type liquid spray devices, and more particularly, to an automatic spray gun manifold having a modular construction.

BACKGROUND OF THE INVENTION

Modular spray gun manifold assemblies that include a plurality of laterally spaced spray guns supported in a row for discharging an elongated spray pattern are known. Such manifolds are used, for example, in pill coating machines in the pharmaceutical industry. In these applications, the manifold must be movable between a predetermined operative position relative to a rotatable pill tumbler for applying the coating and a position in which the manifold is arranged away from the tumbler to facilitate cleaning.

Current manifold designs require a support structure to hold the spray guns in place. The size and weight of these manifold supports makes it difficult to mount the manifold in cantilever fashion, such as from a pivot door of a pill coating machine and to manipulate the manifold as may be required during use and/or cleaning. Moreover, current manifolds typically require a multiplicity of fluid supply lines that run along the support structure and communicate with each spray nozzle. This type of manifold not only requires extensive plumbing, but it is also difficult to clean, particularly to the extent required for use in pharmaceutical and food applications.

OBJECTS AND SUMMARY OF THE INVENTION

Accordingly, in view of the foregoing, an object of the present invention is to provide an improved lightweight spray gun manifold adapted for easier mounting and manipulation.

Another object is to provide a modular spray gun manifold as characterized above which eliminates the necessity for massive support members that significantly increase the weight of the manifold and impede easy movement of the manifold.

A further object is to provide a modular spray gun manifold of the above kind in which fluid directing conduits constitute the support structure of the manifold.

Still another object is to provide a modular spray gun manifold of the foregoing type that is adapted for easy disassembly for cleaning, or for enabling a change in the number of spray guns in the manifold.

Other objects and advantages of the invention will become apparent upon reading the following detailed description and upon reference to the drawings, in which:

DETAILED DESCRIPTION OF THE INVENTION

Figure 1:
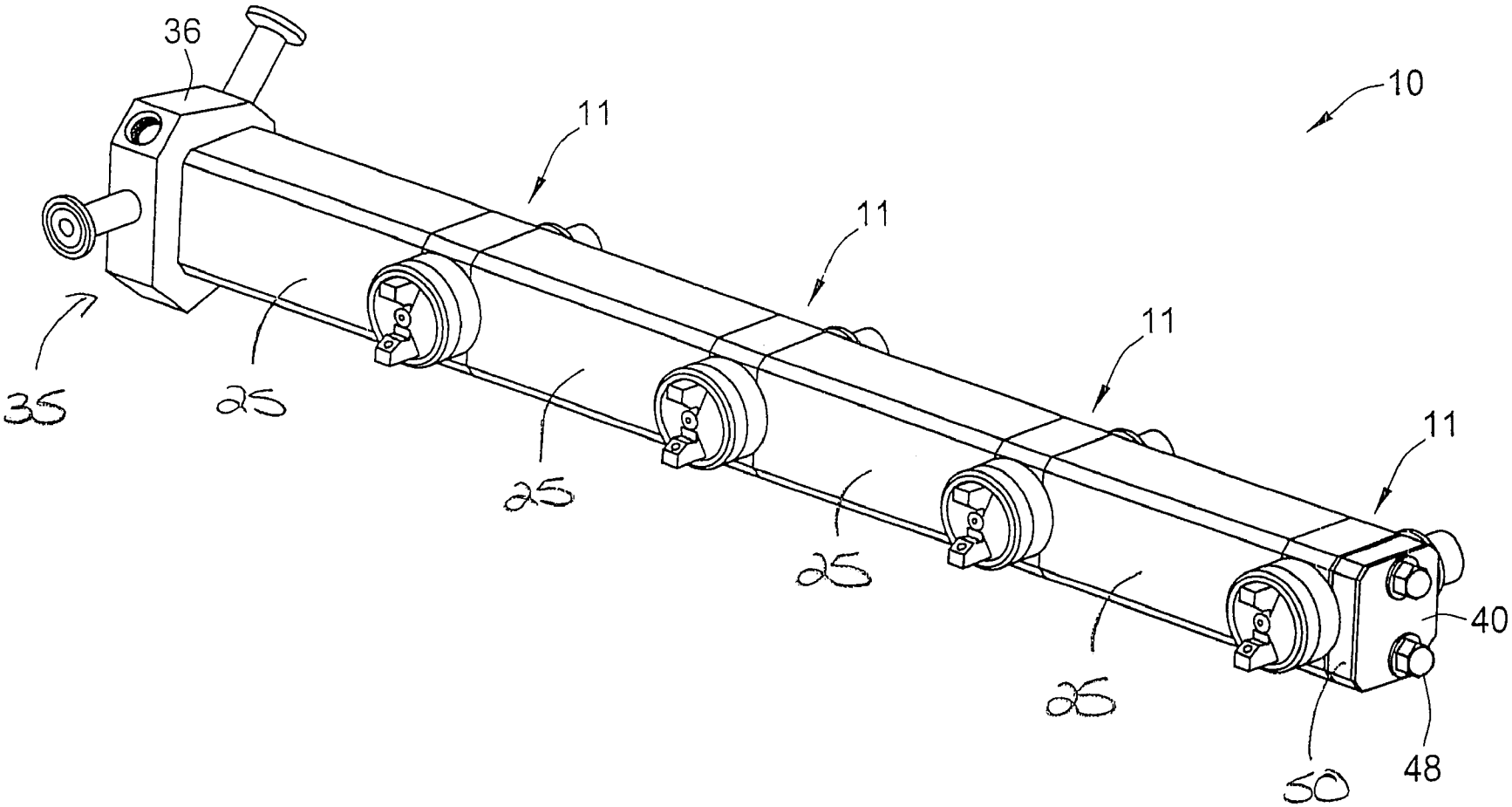
FIG. 1 is a perspective view of an exemplary modular spray gun manifold in accordance with the invention.

Referring now more particularly to FIG. 1 of the drawings, there is shown an illustrated modular spray gun manifold 10 in accordance with the invention. The manifold 10 includes a plurality of spray gun modules 11 each of which includes a rectangular block-shaped body 12, a spray nozzle assembly 13 supported at one end of the module body 12, and an actuator 14 supported at the opposite end of the module body 12. The basic structure and mode of operation of the spray gun modules are known in the art, for example, as shown in U.S. Pat. No. 5,707,010 assigned to the same assignee of the present application, the disclosure of which is incorporated herein by reference. The overall structure and mode of operation of the spray gun modules 11 should be understood to be illustrative of only one example of spray device with which the present invention may be used.

The spray nozzle assembly 13 of the illustrated spray gun module 11 is an external mix type of spray nozzle, namely a nozzle in which liquid and pressurized air or other gases are mixed externally of a liquid discharge orifice to produce a predetermined atomized spray pattern. The spray nozzle assembly 13 comprises a nozzle body and an air cap 18 releaseably mounted at the discharge end of the module body by a retaining ring 19, which in this case threadably engages the module body (see FIGS. 1 and 2). As is known in the art, "atomizing" air directed through the nozzle assembly interacts with and atomizes the discharging liquid and "fan air" directed through the air cap 18 further atomizes, forms and directs the discharging liquid spray. While an external mix type nozzle is illustrated, it will be understood that the present invention is not limited to any type of spray nozzle. For example, an internal mix type spray nozzle or any other suitable spray nozzle could be used.

The actuator 14, which also may be of a known type, has an end cap secured by a retaining ring that threadably engages an opposite end of the module body 12, and a valve needle with a piston that is selectively moved between valve on and off positions in a high speed cyclic mode through direction of pressurized air (i.e., control air) to the piston. While in the illustrated embodiment the spray nozzle assembly 13 and actuator 14 are individually mounted on and affixed to the module body 12, alternatively, the spray nozzle assembly and actuator may be part of a unitary removable cartridge, as disclosed in application Ser. No. 220,589 also assigned to the same assignee as the present application, the disclosure of which also is incorporated herein by reference. Of course, other types of actuators and spray nozzle assemblies could also be used and the present invention is not limited to any single type of actuator or spray nozzle.

Figure 2:
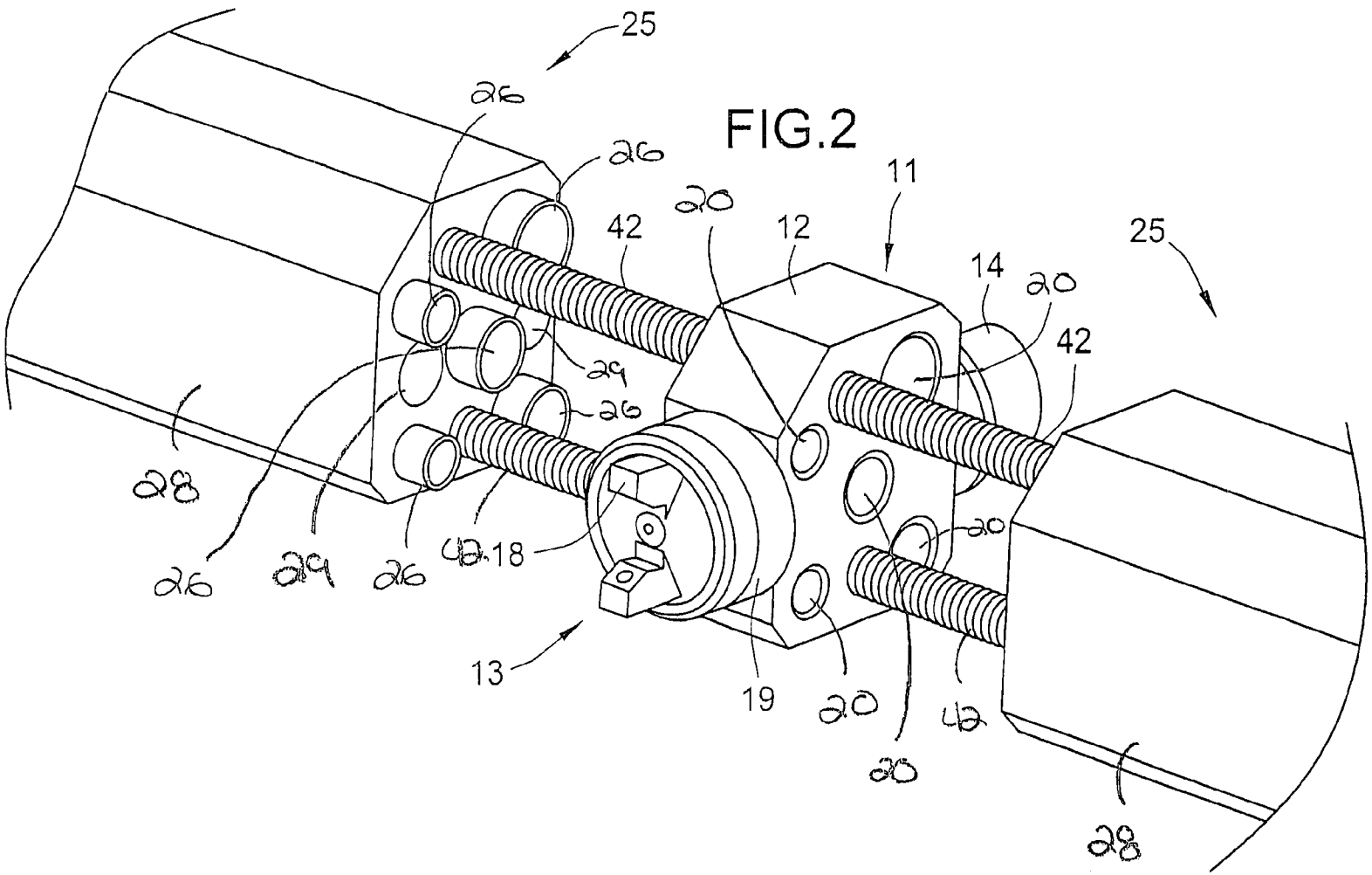
FIG. 2 is an enlarged, partially exploded perspective view of the modular spray gun manifold of FIG. 1 showing one of the spray gun modules and the adjacent supporting support assemblies.
Figure 5:
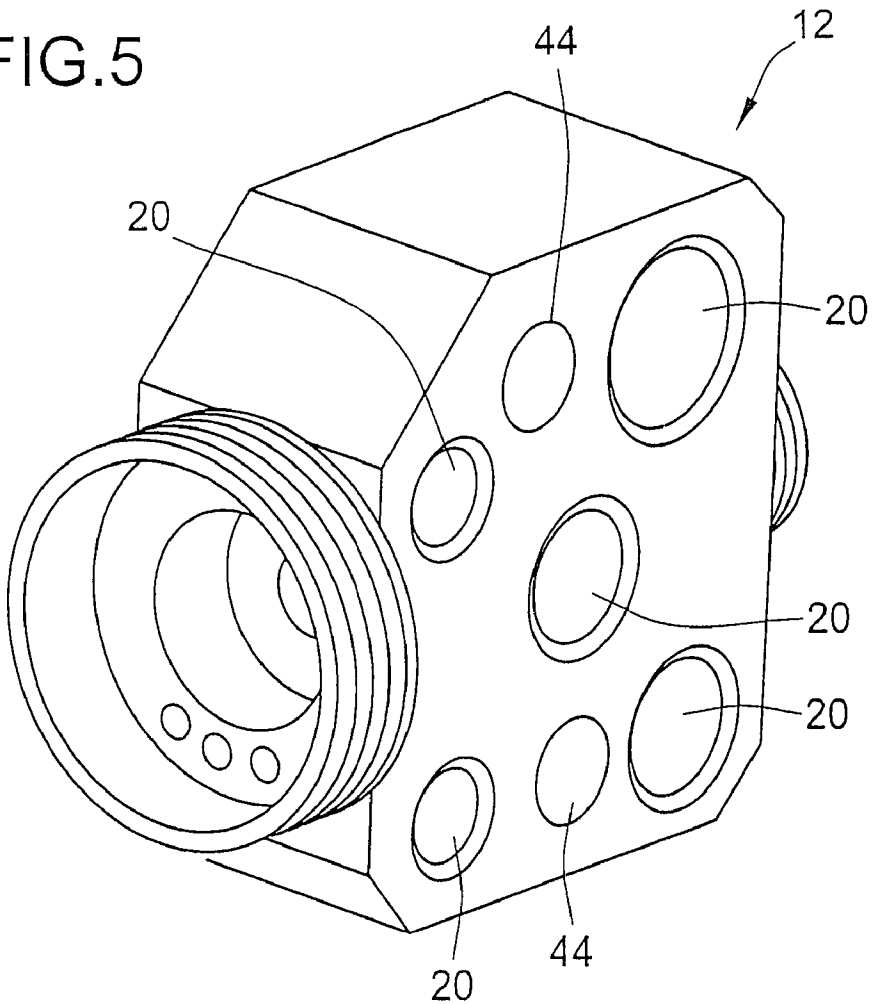
FIG. 5 is a perspective view of the body of one of the spray gun modules of the modular spray gun manifold of FIG. 1.

For permitting communication of liquid, atomizing air, fan air, and control air to the spray gun module 11, the module body 12 is formed with a plurality of respective fluid passages 20 extending transversely through opposite sides of the module body 12 that permit communication of fluids both to the spray nozzle assembly 13 and actuator 14 and through the module body 11 (see FIGS. 2 and 5). In this case, the module body 11 is also formed with a further return passage 20 for permitting recirculation of the liquid as explained in greater detail below.

In accordance with an important aspect of the invention, the manifold 10 has a lightweight, easy to manipulate and support construction with the spray gun modules 11 being connected and supported by the fluid communicating passages or conduits connecting the modules without the necessity for massive or heavy support plates or other structure. More particularly, the manifold 10 has a relatively lightweight construction that permits easy cantilever support of the manifold from a single end thereof and which can be easily disassembled for cleaning. In the illustrated embodiment, the spray gun modules 11 are interconnected in laterally spaced apart relation by fluid communication and support assemblies 25 interposed between adjacent spray gun modules 11 (see FIG. 1).

Figure 3:
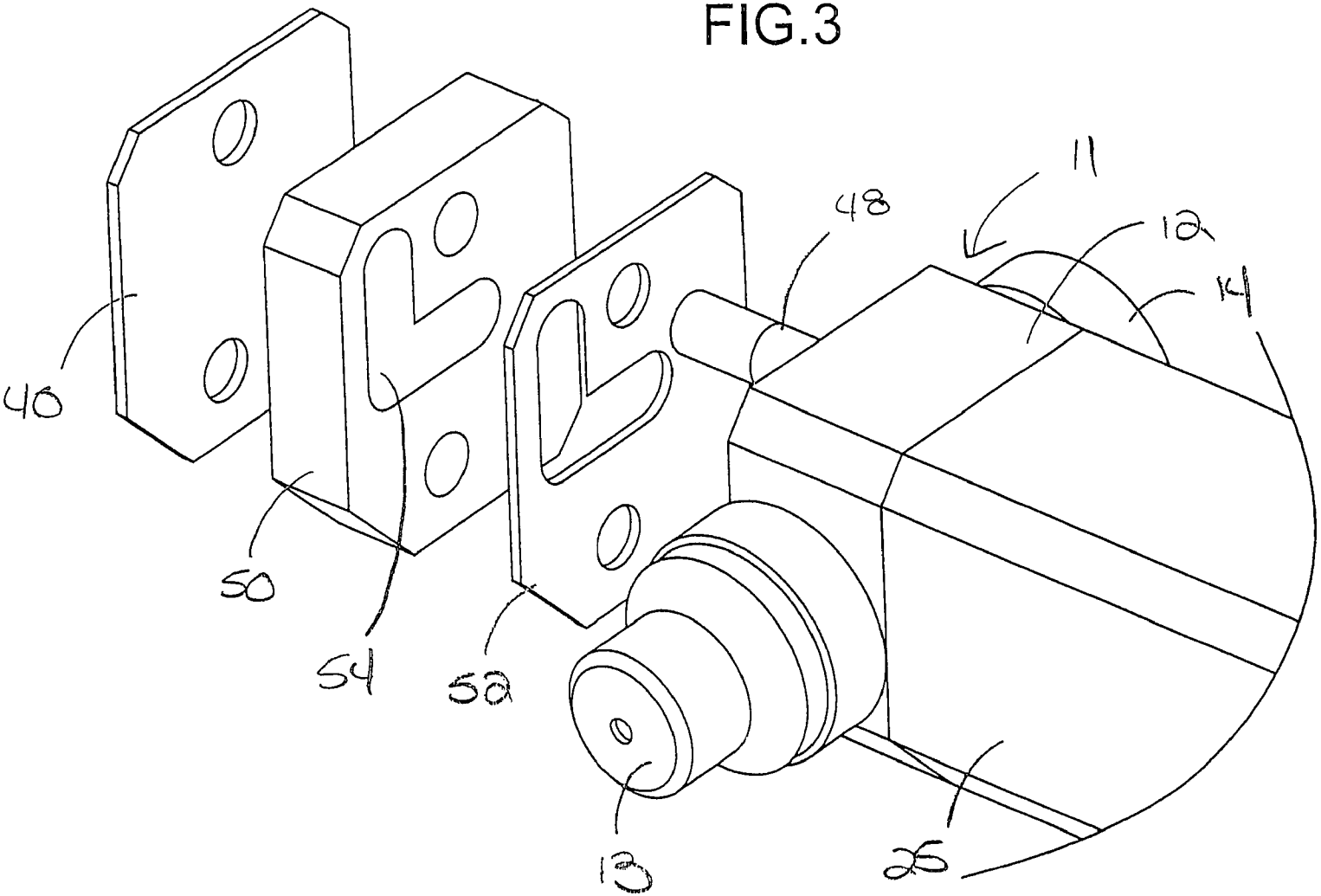
FIG. 3 is an enlarged, partially exploded perspective view of the modular spray gun manifold of FIG. 1 showing the end spray gun module and the adjacent fluid return plate.
Figure 4:
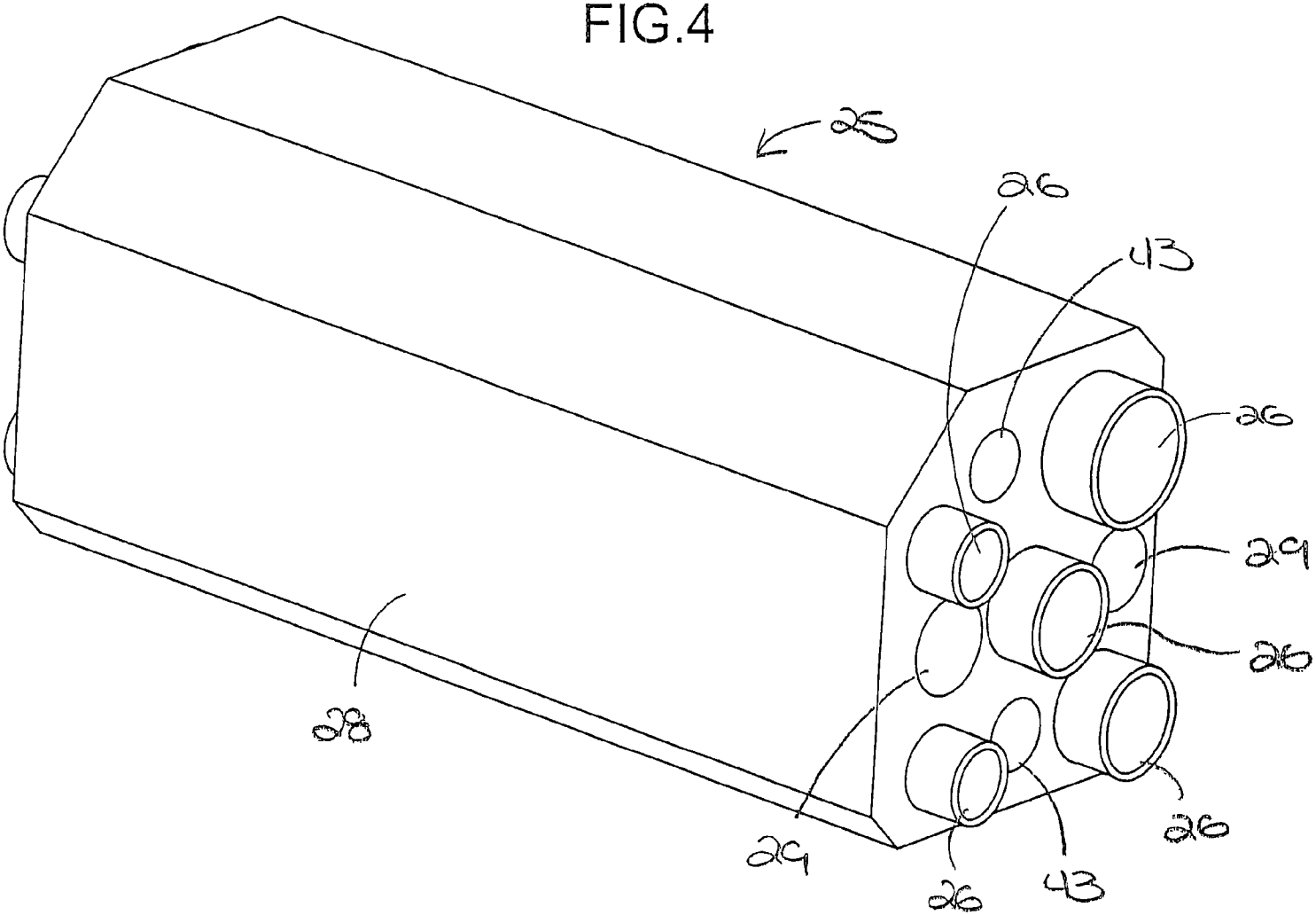
FIG. 4 is a perspective view of one of the supporting support assemblies of the modular spray gun manifold of FIG. 1.

The support assemblies 25 in this case include a plurality of fluid conduits 26 for supplying liquid, atomizing air, cylinder air, and control air to the passages 20 in the module bodies as shown in FIG. 4. In the embodiment illustrated in FIGS. 1-4, the support assemblies 25 comprise blocks 28 within which the fluid conduits 26 are embedded. Preferably, the blocks 28 are made of a relatively lightweight material such as Teflon® or the like. To further reduce the weight of the blocks, the illustrated support assemblies have a pair of additional passages 29 therethrough which are not necessarily used to direct fluid. The fluid conduits 26 each preferably extend outwardly a small distance beyond the respective ends of the blocks for insertion into the passages 20 with a threadless union therebetween (see, e.g., FIG. 2). Appropriate sealing members are provided about the fluid conduits 26.

Figure 6:
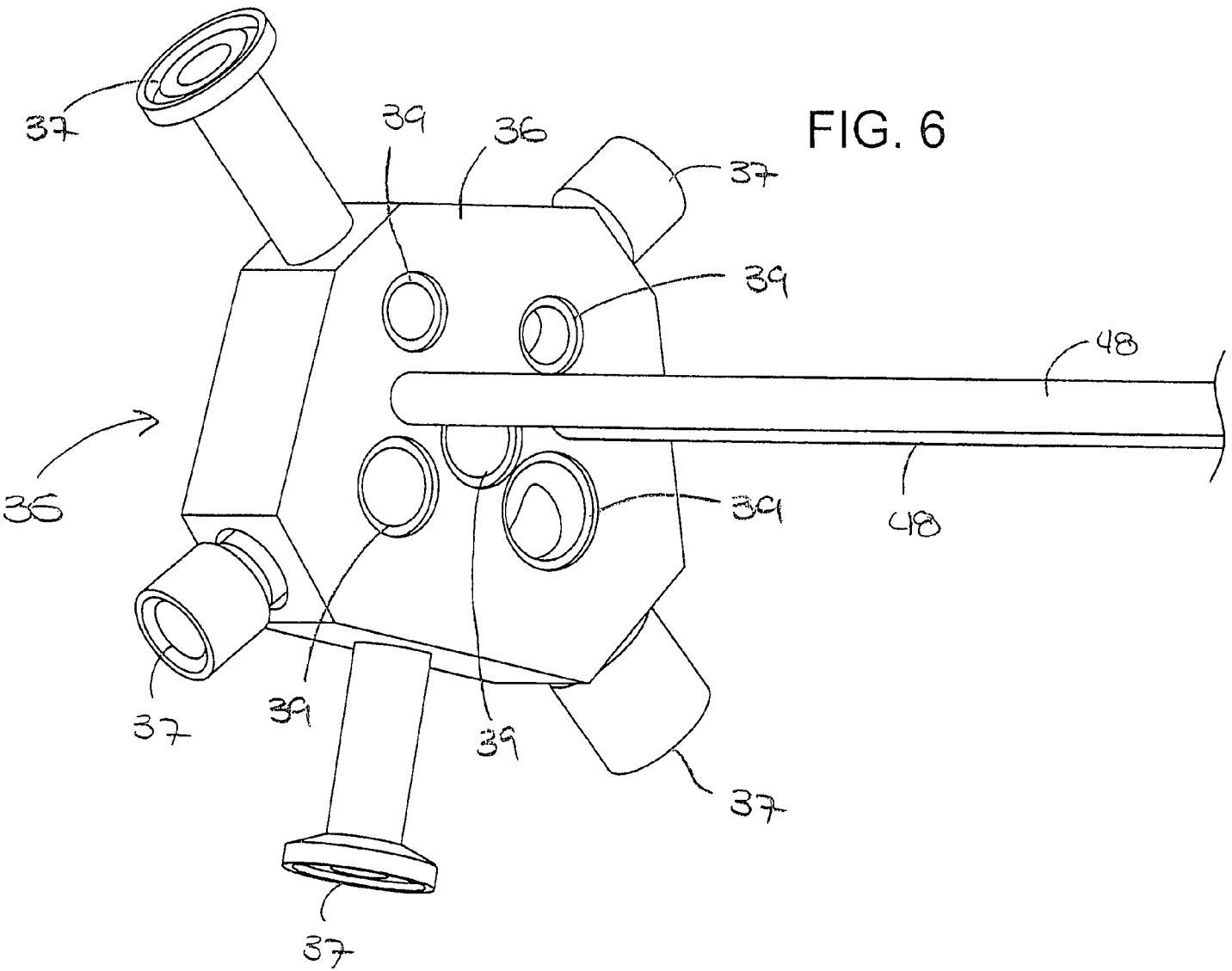
FIG. 6 is a perspective view of the junction plate of the modular spray gun manifold of FIG. 1.

In carrying out the invention, to permit communication of fluids to the support assemblies 25 and the interconnected spray gun modules 11 and to further enable cantilever support of the manifold 10, a support and junction plate 35 is mounted at an upstream end of the manifold 10. As shown in FIG. 6, the junction plate 35 in this case has an end plate portion 36 formed with a plurality of radial fluid connections 37 to which respective fluid supply lines can be connected at the end of the manifold. These connections 37 communicate with respective passages 39 that mate up with and communicate with the conduits 26 of the adjacent support assembly 25 when the manifold is assembled. For enabling cantilever support of the junction plate 35, an integrally formed mounting flange 38 (see FIG. 7) can extend in axial relation to the end plate portion 36 for coupling to a pivot door or other support structure.

As shown in FIG. 3, an end plate 40 in this case is mounted against and closes the end of the last spray gun module in the downstream direction. It will be understood that fluid communicated to the radial passageways 37 of the junction plate 35 will communicate through the support assemblies to and through each spray gun module 11. To permit recirculation of fluid back through the manifold 10, a fluid return plate 50 can be provided after the last spray gun module 11 before the end plate 40 as shown in FIG. 3. In this case, the fluid return plate 50 is separated from the last spray gun module 11 by a gasket 52. The fluid return plate 50 includes a slot 54 that communicates with two of the fluid passages 20 in the last spray gun module 11 thereby establishing a path by which fluid can move between the two passages. Thus, the slot allows fluid exiting one of the passages 20 to recirculate back into the other passage 20 and from there back through the manifold 10 in the upstream direction through respective recirculation passages 20 in the other spray gun modules 11 and corresponding recirculation conduits 26 in the support assemblies 25.

In further carrying out the invention, for releaseably securing the spray gun modules 11 of the manifold 10 in assembled relation to each other while permitting easy disassembly for cleaning and/or for addition or reduction in the number of spray gun modules 11, a pair of externally threaded retaining rods 42 are provided each of which extends the entire length of the manifold 10 and through the individual spray gun module bodies 12. In this case, each of the retaining rods 42 engage the junction plate 35 (see FIG. 6), extend through respective additional passages 43 of each support assembly 25 which house the rods (see, e.g., FIG. 4), through transverse passages 44 in the spray gun body 12 parallel to the fluid passages 20 (see FIG. 5), and through the end plate at the downstream end of the manifold (see FIG. 3). The passages 43 that house the retaining rods in this case do not protrude beyond the respective ends of the support assembly blocks. Wing nuts 49 are threaded onto the protruding ends of the retaining rods 42 to secure the spray gun modules 11 and support assemblies 25 in interposed relation between the retaining plate 40 and the junction plate 35 (see FIG. 1).

It will be seen that by removal of the wing nuts 49 and separation of the support assemblies 25 and spray gun modules 11 by reason of their threadless unions, the manifold 10 can be easily disassembled for cleaning. Likewise, the number of spray gun modules 11 can be easily modified simply by changing the number of spray gun modules 11 and support assemblies 25 and the length of the retaining rods 42.

Figure 7:
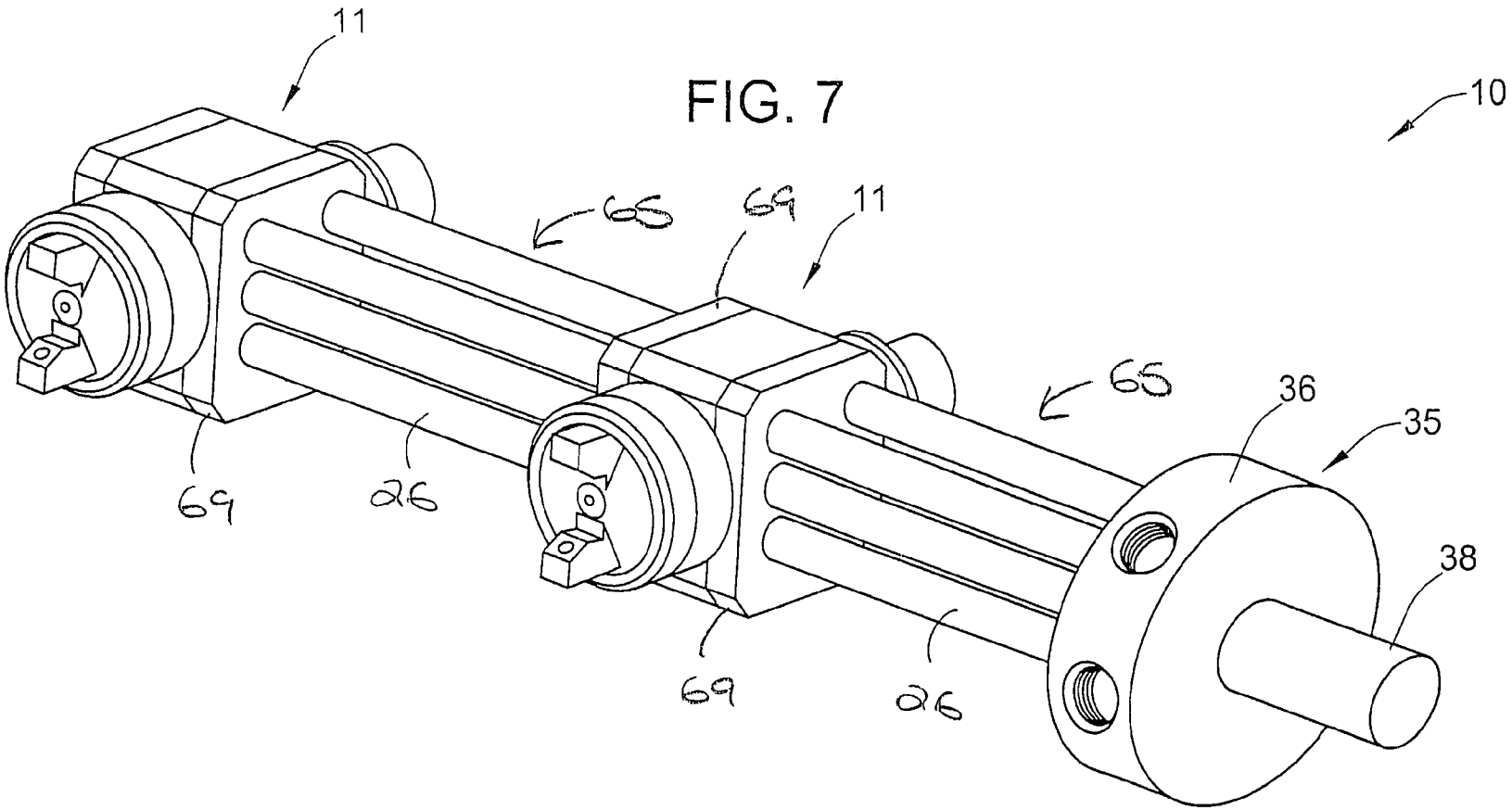
FIG. 7 is a perspective view of an alternative embodiment of a modular spray gun manifold according to the present invention.
Figure 8:
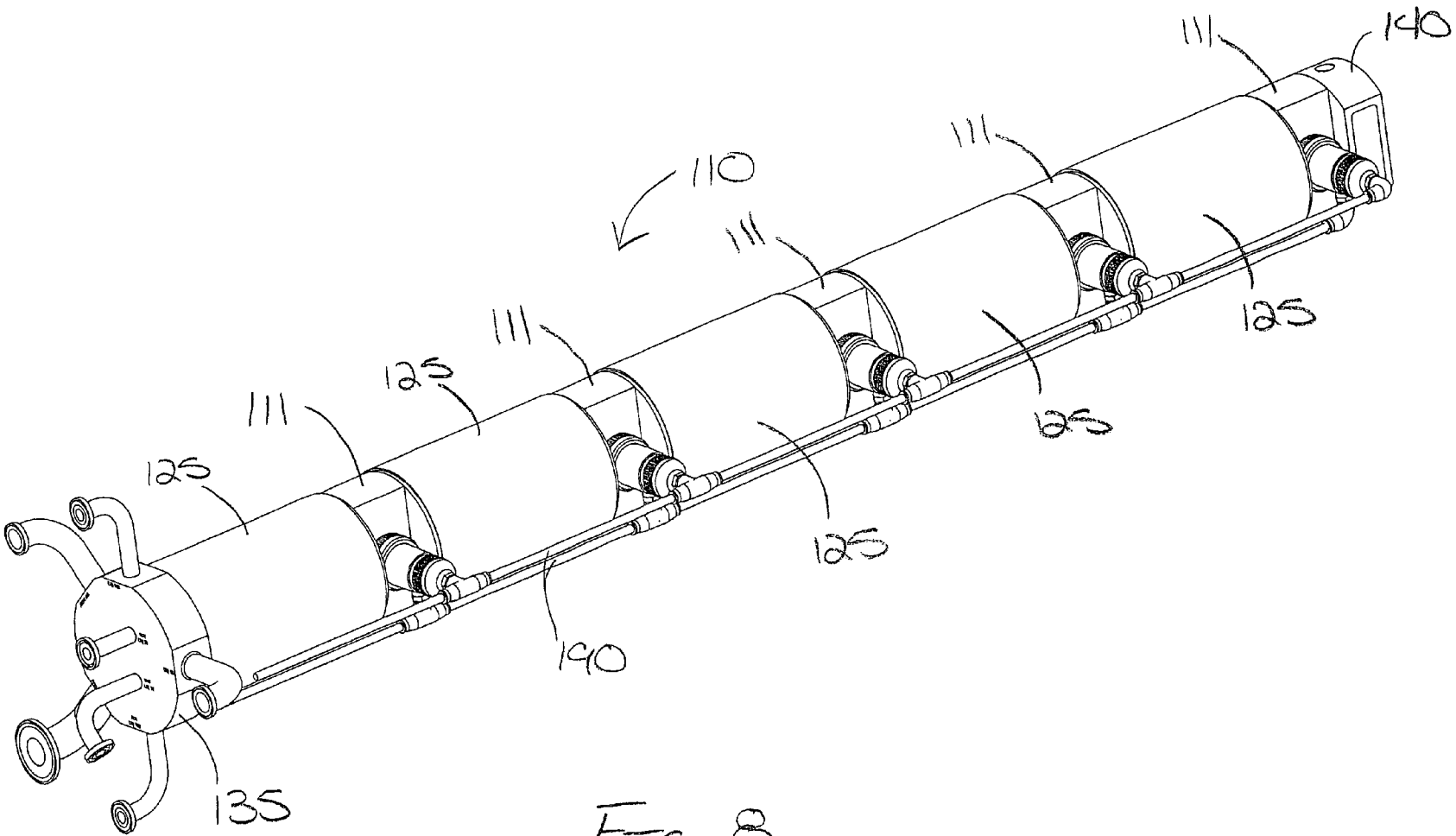
FIG. 8 is a perspective view of another alternative embodiment of a modular spray gun manifold according to the invention in which the liquid to be sprayed and the atomizing air can be heated.

A manifold 10 having an alternative embodiment of the support assemblies 65 is shown in FIG. 7. In the FIG. 7 embodiment, instead of a block configuration, the fluid conduits 26 associated with each of the support assemblies 65 are exposed. In the illustrated embodiment, the conduits 26 are supported relative to each other by lightweight end plates 69 are provided at opposite ends of the support assemblies 65. The junction plate 35 also has a slightly different configuration and includes a mounting flange 38.

A further embodiment of a modular spray gun manifold 110 according to the invention is shown in FIGS. 8-18. In this embodiment, the modular spray gun manifold 110 is configured for discharging more viscous fluids such as wax, sugar slurry, grease, oil and adhesives. These viscous fluids thicken or solidify when cooled, making atomization and spraying of such fluids difficult. In order to prevent such fluids from thickening or solidifying, the fluid and atomizing air lines of the modular spray gun manifold 110 of FIGS. 8-18 are heated in order to keep the fluids at a temperature where they are less viscous and therefore easier to discharge.

Figure 14:
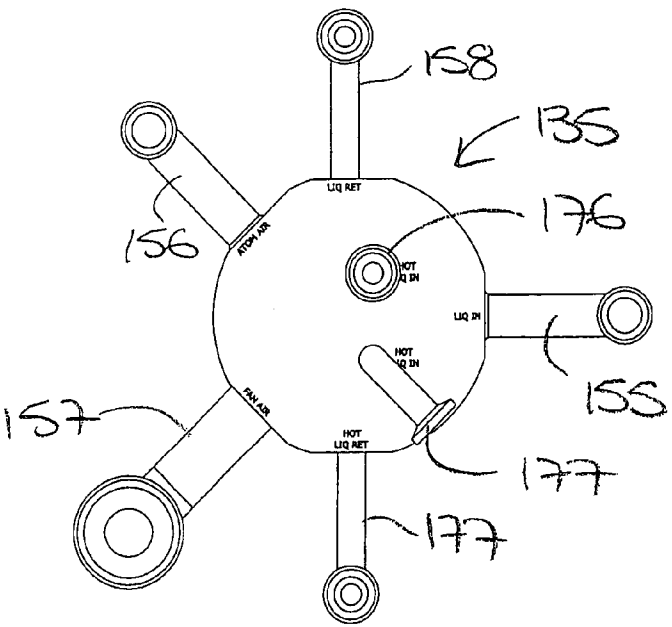
FIG. 14 is an end view of the junction plate of the heated spray gun manifold of FIG. 8.

Elements of the embodiment of FIGS. 8-18 that are similar to elements of the embodiments of FIGS. 1-7 have been given corresponding reference numbers in the 100's. As with the embodiments of FIGS. 1-7, the spray gun manifold 110 illustrated in FIGS. 8-10 includes a plurality of spray gun modules 111 that are interconnected in laterally spaced apart relation by fluid communication and support assemblies 125 that are interposed between adjacent spray gun modules. At the upstream end of the manifold 110, there is a junction plate 135 having a plurality of connections 137 to which various fluid supply lines can be connected to the manifold 110. For example, as shown in FIG. 14, the junction plate 135 includes connections for the process fluid to be sprayed (connection 155), the atomizing air (connection 156), the fan air (connection 157) and a connection for recirculating process fluid (connection 158). An endplate 140 (see FIGS. 8-10) is mounted against and closes the end of the last spray gun module 111 in the downstream direction. The components of the manifold 110 are held in assembled relation by a plurality of retaining rods 142 in a similar manner to the embodiments of FIGS. 1-7. Specifically, in the illustrated embodiment, four retaining rods extend the length of the manifold 10 through corresponding retaining rod passages 143, 144 in the support assemblies 125 and spray gun modules 111 (see FIGS. 12 and 15, respectively).

Figure 9:
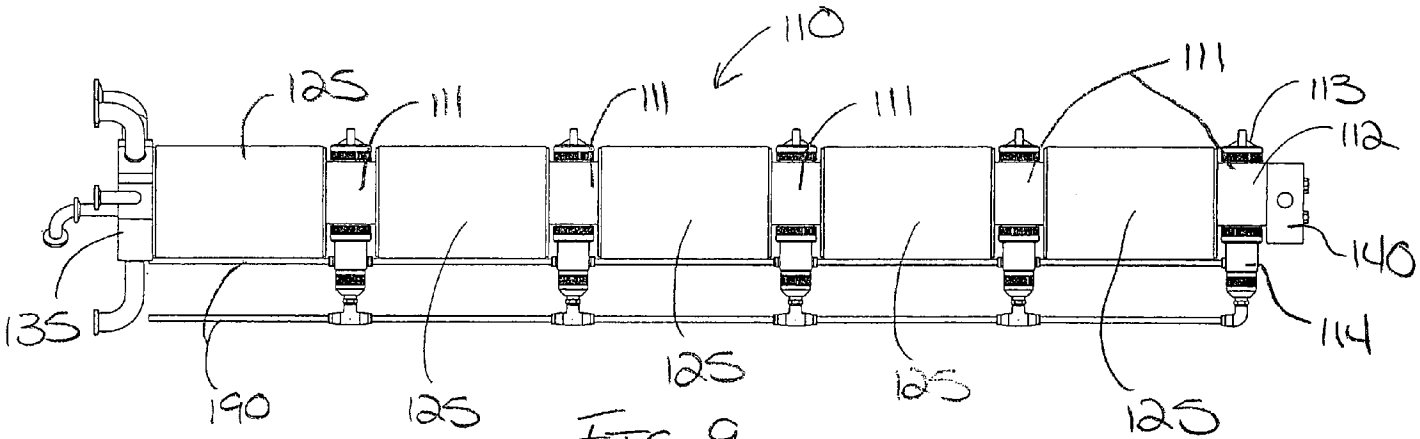
FIG. 9 is a plan view of the heated modular spray gun manifold of FIG. 8.
Figure 10:
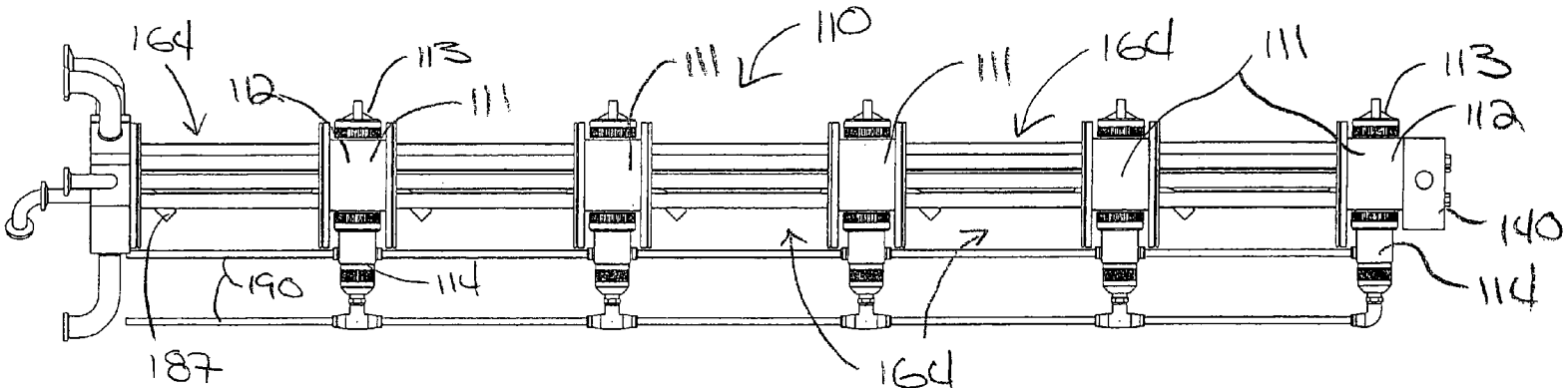
FIG. 10 is a plan view of the heated modular spray gun manifold of FIG. 8 in which the walls of the heat exchanging support assemblies are cutaway.
Figure 15:
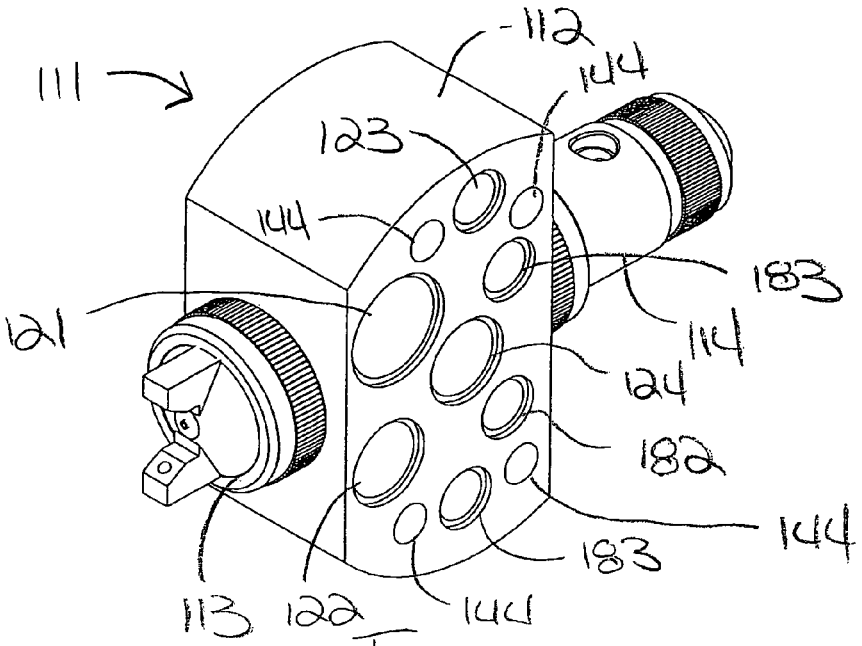
FIG. 15 is a perspective view of one of the spray gun modules of the heated spray gun manifold of FIG. 8.

As shown in FIGS. 9, 10 and 15, each of the spray gun modules 111 includes a generally block-shaped module body 112 that supports a spray nozzle assembly 113 and an actuator 114. The basic structure and operation of the spray gun assemblies 113 and actuators 114 are the same as in the embodiments of FIGS. 1-7 and are known in the art, for example, as shown in the aforementioned U.S. Pat. No. 5,707,010. As with the earlier embodiments, the overall structure and mode of operation of the spray nozzle assemblies and actuators should be understood as one example of a spray device which with the present invention may be employed.

For permitting communication of the process fluid to be sprayed, atomizing air and fan air to the spray gun module 111, the module body 112 is formed with a plurality of fluid passages extending transversely through the nozzle body as shown in FIG. 15. These passages permit communication of fluids both to the spray nozzle assembly 113 and through the module body 112. The passages also permit recirculation of any process fluid that is not sprayed thereby helping to ensure that any solid material in the process fluid remains in suspension. In the illustrated embodiment, the module body 112 includes an atomizing air passage 121, a fan air passage 122 and a process fluid supply passage 123 all of which communicate with the spray nozzle assembly 113 and extend through the module body 112 and a process fluid return passage that extends through the module body.

Figure 11:
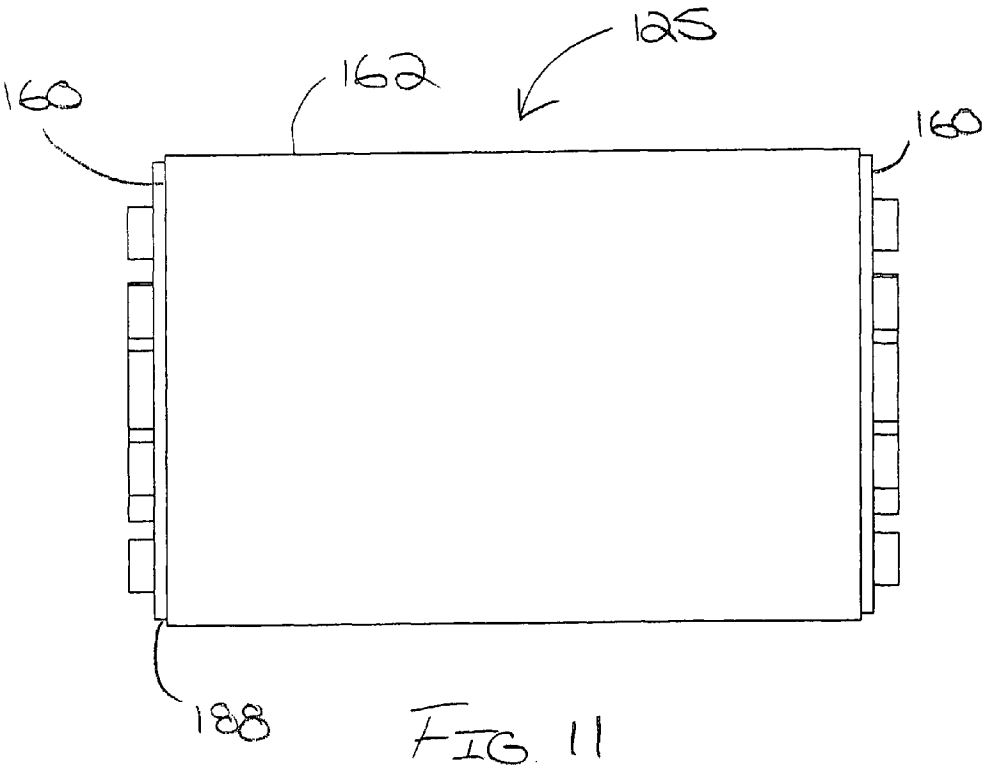
FIG. 11 is a side view of one of the heat exchanging support assemblies of the heated modular spray gun manifold of FIG. 8.
Figure 12:
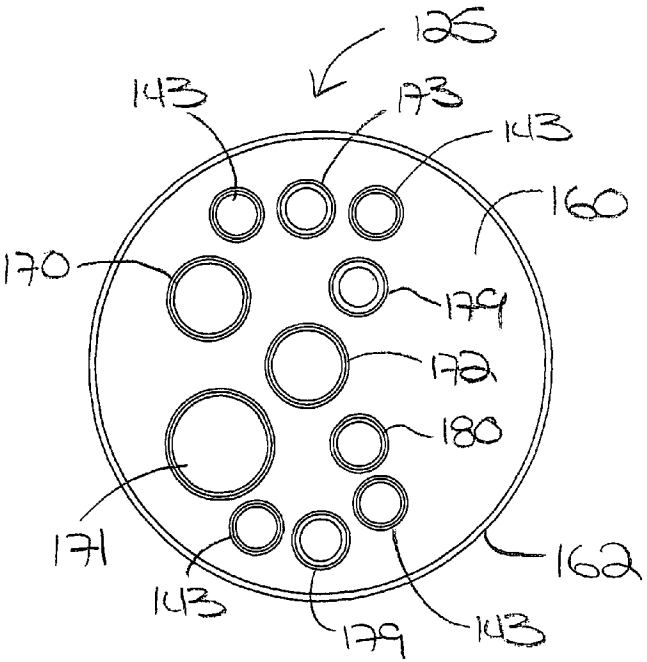
FIG. 12 is an end view of one of the heat exchanging support assemblies of the heated modular spray gun manifold of FIG. 8.
Figure 13:
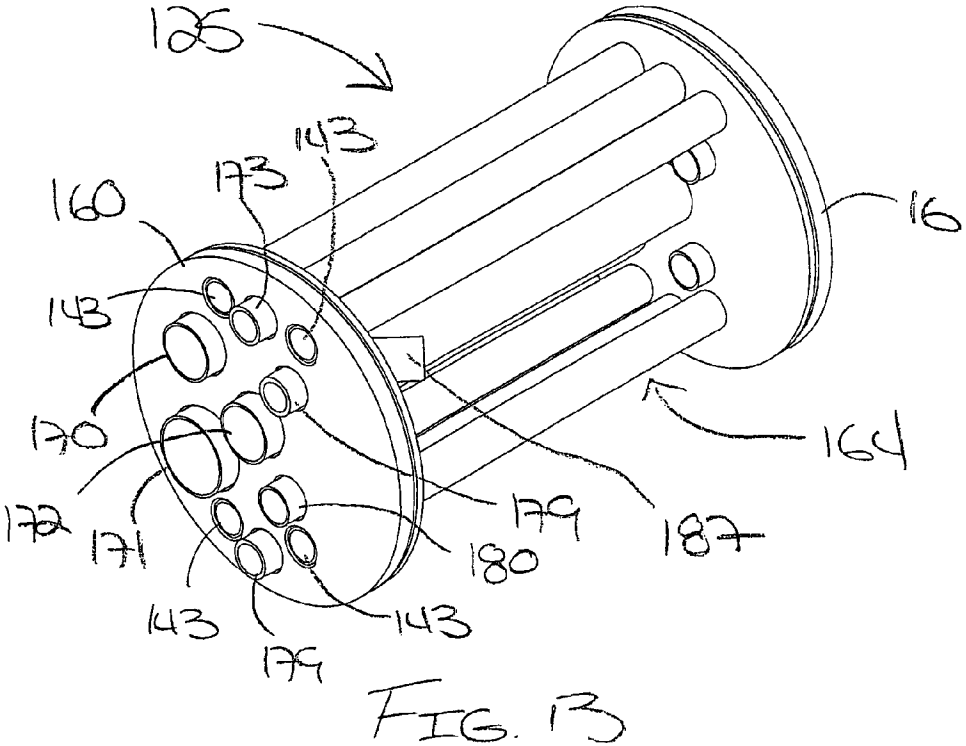
FIG. 13 is a perspective view of one of the heat exchanging support assemblies of the heated modular spray gun manifold of FIG. 8 with the walls of the support assembly cutaway.

In accordance with one aspect of the invention, the support assemblies 125 are configured to heat the process fluid, atomizing air and fan air that is transmitted to the spray gun modules 111. In this case, each support assembly 125 has a generally cylindrical configuration with a pair of opposing endplates 160 and an outer wall 162 defining a hollow, interior space 164 as shown in FIGS. 11-13. A plurality of fluid conduits extend through the interior space 164 between respective openings in the opposing endplates 160 (see FIG. 13). The conduits supply atomizing air, fan air and process liquid to be sprayed to the respective passages in the spray modules. In particular, the illustrated support assembly 125 includes an atomizing air conduit 170, a fan air conduit 171, a process fluid supply conduit 172 and a process fluid return conduit 173 (see FIGS. 12 and 13) which are open at either endplate 160 (see FIG. 11). As with the earlier embodiment, each of the fluid conduits 170, 171, 172, 173 preferably includes a neck portion that extends a short distance outward from each of the endplates 160 (see FIGS. 11 and 13) for insertion into the respective passages in the spray gun modules 111 with a threadless union therebetween. In one preferred embodiment, the outer wall 162 of the support assembly 125 can comprise 4.5 inch diameter, schedule 10 pipe.

In order to heat the conduits 170, 171, 172, 173, and in turn their contents, the support assemblies 125 function as a type of heat exchanger. In particular, a hot, heat transfer fluid, which can comprise water, ethylene glycol or any other suitable fluid, is received in the hollow, interior space 164 of each of the heat exchanging, support assemblies 125. The manifold 110 is designed to circulate the hot, heat transfer fluid around the conduits 170, 171, 172, 173 in the individual support assemblies 125 as well as through the interior spaces 164 of the various support assemblies that are included in the manifold 110.

To this end, as shown in FIG. 14, the junction plate 135 includes, in this case, two heat transfer fluid inlet connections 176 and one heat transfer fluid return connection 177 all of which can be connected to a supply of heat transfer fluid that can circulate hot, heat transfer fluid through the manifold 10. Moreover, as shown in FIGS. 12 and 13, the endplate 160 at the upstream end of each support assembly 125 includes two heat transfer fluid inlets 179 through which hot heat transfer fluid is fed into the interior space 164 of the support assembly 125 in the downstream direction and one heat transfer fluid outlet 180 through which recirculating heat transfer fluid traveling upstream exits the interior of the support assembly. The endplate 160 at the downstream end of each support assembly 125 (see FIG. 11), in turn, includes two heat transfer fluid outlets through which hot heat transfer fluid is directed in the downstream direction to a spray gun module 111 and one heat transfer fluid inlet through which recirculating heat transfer fluid traveling upstream is directed into the interior space of the support assembly 125.

The spray gun module bodies 112 also include passages for circulating the heat transfer fluid through the manifold 110. In particular, as shown in FIG. 15, each spray gun module body includes two passages 182 for heat transfer fluid heading in the downstream direction and one passage 183 for recirculating heat transfer fluid traveling in the upstream direction. The heat transfer fluid passages 182, 183 in the spray gun module bodies 112 mate with the corresponding heat transfer fluid inlets and outlets 179, 180 in the adjoining support assemblies 125 so that the heat transfer fluid can travel in both the upstream and downstream directions through the various support assemblies 125 and spray gun modules 11 in the manifold 110. As with the support assembly conduits, each of the heat transfer fluid inlets and outlets 179, 180 on the support assembly 125 includes a neck that protrudes from the respective endplate 160 to facilitate connection with the corresponding heat transfer fluid passages 182, 183 in the spray gun modules 111.

Figure 16:
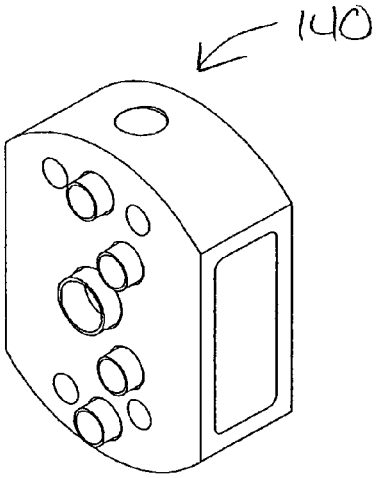
FIG. 16 is a perspective view of the end plate of the heated spray gun manifold of FIG. 8.
Figure 18:
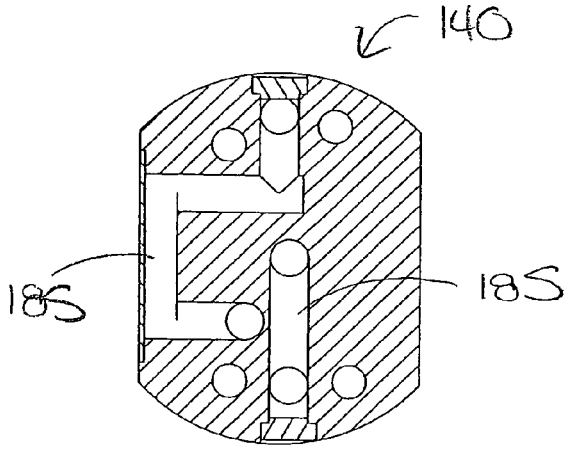
FIG. 18 is a cross-sectional view of the end plate of the heated spray gun manifold of FIG. 8 taken in the plane of line 18-18 in FIG. 17.
Figure 17:
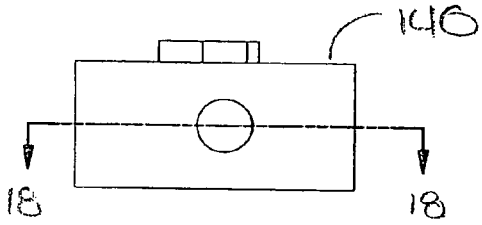
FIG. 17 is a top view of the end plate of the heated spray gun manifold of FIG. 8.

To facilitate recirculation of the heat transfer fluid, in the illustrated embodiment, the endplate 140 of the manifold includes a recirculation passage 185 that allows the heat transfer fluid that has traveled downstream through the support assemblies 125 and spray gun modules 111 to recirculate back through the manifold 110 in the upstream direction as shown in FIGS. 16-18. In this case, the endplate 140 also includes a second recirculation passage 185 that permits the process fluid that has not been sprayed to recirculate in the upstream direction back through the manifold 110.

To facilitate circulation of the heat transfer fluid through the interior of the support assembly 125, one or more of the heat transfer fluid inlets 179 can be adapted to discharge fluid into the interior 164 of the support assembly in a direction that transverse to the longitudinal axis of the support assembly. In this case, one of the heat transfer fluid inlets 179 at the upstream end of the support assembly 125 is connected to an elbow-shaped tubing 187 that extends inward into the interior space 164 of the support assembly at an angle relative to the longitudinal axis of the support assembly as shown in FIGS. 10 and 13. The other heat transfer fluid inlet 179 directs the heat transfer fluid straight into the interior of the support assembly 125 in a direction parallel to the longitudinal axis. Having the two inlets 179 discharge the heat transfer fluid in different directions helps ensure that good circulation is achieved within the interior of the support assembly 125.

In order to facilitate a tight connection between the support assemblies 125 and the spray gun modules 11, the endplates 160 of the support assemblies can have a reduced diameter neck portion 188 adjacent the outer end of the endplates as best shown in FIG. 11. In addition, gaskets can be provided at the junctions between the support assemblies 125 and the spray gun modules 111 in order to compensate for any manufacturing tolerance issues. The gaskets can have a shape that corresponds to the profile of the spray gun modules 111.

In order to help optimize performance of the spray gun module 111, the module bodies 112 are configured to minimize the length of the valve needle that is present in the actuator 114. In particular, the module bodies 112 have a reduced thickness from front-to-back as compared to the support assemblies 125. As a result, the outer surface of the module bodies 112 are recessed from the outer surface of the support assemblies 125 at the front of the manifold 110 where the spray nozzle assemblies 113 are arranged at that the rear of the manifold where the nozzle actuators 114 are arranged as shown in FIGS. 9 and 10. This arrangement allows the valve needle of the actuator 114 to be relatively shorter than it would be if the module bodies 112 had the same profile as the support assemblies 125. In the illustrated embodiment, the manifold 110 includes a pair of control air lines 190 (see FIGS. 8-10) that extend along the manifold outside of the support assemblies 125 and are connected to the actuators 114 of the various spray gun modules 111. These control air lines 190 control movement of the valve needles of the spray gun module actuators 114 between the open and closed positions. Those skilled in the art will appreciate that other mechanisms could be used to control the operation of the actuators of the spray gun modules.

From the foregoing, it can be seen that the modular spray gun manifold of the present invention has a lightweight construction which enables its support and manipulation without the necessity for massive support bars or other structures typical of the prior art. The manifold also has a relatively simple construction which lends itself to economical manufacture, efficient cleaning, and easy modification for particular spray applications.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A modular automatic spray gun manifold comprising:

a plurality of spray gun modules arranged in a lateral array with sides of said spray gun modules being in laterally spaced relation from each other along said array;

a respective support assembly arranged between the sides of each adjacent pair of spray gun modules for supporting the adjacent pair of spray gun modules in laterally spaced relation to each other, said support assemblies each comprising an individual discrete support module free of contacting relation with other of said support assemblies defining an interior space through which a plurality of fluid conduits extend and having lateral sides that are disposed in interposed relation between pairs of said spray gun modules, a source of a first fluid having an inlet at one end of said lateral array for supplying said first fluid successively through each spray gun module and fluid conduits between said spray gun module for direction from said spray gun modules, a source of a heated second fluid having a temperature higher than said first fluid and having an inlet adjacent an end of said lateral array for communicating said second heated fluid successively through said spray gun modules and respective support assemblies for heating said first fluid communicating through said fluid conduits.

2. The spray gun manifold according to claim 1 wherein the inlet of the second heated fluid source communicates with an elbow that discharges said heated second fluid into the interior space of the respective support assembly in a direction transverse to a longitudinal axis of the interior space of the respective support assembly.

3. The spray gun manifold according to claim 1 wherein each support assembly includes a heat transfer fluid outlet for communicating said heated second fluid in a downstream direction to the adjacent spray gun module.

4. The spray gun manifold according to claim 3 wherein each support assembly includes a heat transfer fluid return inlet and a heat transfer fluid return outlet to communicate recirculating the heated second fluid in an upstream direction through the support assembly.

5. The spray gun manifold according to claim 1 wherein each spray gun module includes a module body having an outer surface and wherein a portion of the outer surface of the module body is recessed from an outer surface of at least one adjacent support assembly.

6. The spray gun manifold according to claim 1 wherein one or more retaining elements extend through the spray gun modules and the support assemblies for securing the spray gun modules and support assemblies in assembled relation.

7. The spray gun manifold according to claim 1 wherein each spray gun module includes an external mix type spray nozzle and wherein one of the plurality of fluid conduits in each of the support assemblies communicates atomizing air to the spray gun modules.

8. The spray gun manifold according to claim 1 wherein the spray nozzle of each spray gun module includes an air cap and wherein one of the plurality of fluid conduits in each of the support assemblies communicates fan air to the respective air caps of the spray gun modules.

9. The spray gun manifold according to claim 1 further including a junction element arranged at an upstream end of the manifold that includes a heat transfer fluid supply connection.

10. The spray gun manifold according to claim 1 wherein one of the plurality of fluid conduits in each of the support assemblies is for recirculating fluid and further including a fluid return plate at a downstream end of the manifold that defines a fluid path permitting recirculation of fluid through the spray gun modules and the recirculating fluid conduits of the support assemblies in an upstream direction.

11. The spray gun manifold according to claim 1 in which said second fluid is communicated through each support assembly in surrounding relation to the fluid conduits extending through the support assembly through which said first fluid is directed.

12. The spray gun manifold according to claim 1 in which said second fluid is a liquid.

13. The spray gun manifold according to claim 1 in which said first fluid is a liquid, and including a third gaseous fluid source having an inlet adjacent one end of said lateral array for successive communication through said spray gun modules and at least one fluid conduit in each support assembly.

14. The spray gun manifold according to claim 1 in which said spray gun modules and support modules are releasably secured together to permit selected disassembly and removal of the spray gun and support modules.

15. The spray gun module according to claim 14 in which said spray gun modules and support modules are secured together by a releasable coupling element.

16. A modular automatic spray gun manifold comprising:

a plurality of spray gun modules arranged in a lateral array with lateral sides of said spray gun modules being in laterally spaced relation from each other;

a junction element arranged at an upstream end of the manifold for introducing fluid into the manifold;

a first support assembly arranged between the junction element and a side of a first spray gun module in the spray gun module array for supporting the first spray gun module relative to the junction element, said first support assemblies each comprising an individual discrete support module free and including a plurality of first fluid conduits for supplying fluid to the first spray gun module; and one or more second support assemblies with one second support assembly being with lateral sides thereof arranged in interposed relation between the sides of each adjacent pair of spray gun modules in the array of spray gun modules for supporting the adjacent pair of spray gun modules relative to each other, said second support assemblies each comprising an individual discrete support module free of contacting relation with other of said support assemblies and including a respective plurality of second fluid conduits for communicating fluid between laterally adjacent spray gun modules such that fluid introduced into the manifold through the junction element is communicated to each spray gun module; and each said first support module and each said second support module including an interior space through which the respective first and second plurality of fluid conduits extend and a heat transfer fluid inlet for communicating a hot heat transfer fluid separate from the fluid communicated through the plurality of first and second fluid conduits of the respective support assemblies into the interior space of the respective support module and about the plurality of fluid conduits extending therethrough.

17. The spray gun manifold according to claim 16 including a plurality of heat transfer fluid inlets in each respective support assembly.

18. The spray gun manifold according to claim 16 including a heat transfer inlet of each support assembly communicating with an elbow that discharges heat transfer fluid into the interior space of the respective support assembly in a direction transverse to a longitudinal axis of the interior space of the respective support assembly.

19. The spray gun manifold according to claim 16 wherein each support assembly includes a heat transfer fluid outlet for communicating heat transfer fluid in a downstream direction to the adjacent spray gun module.

20. The spray gun manifold according to claim 19 wherein each support assembly includes a heat transfer fluid return inlet and a heat transfer fluid return outlet to communicate recirculating heat transfer fluid in an upstream direction through the support assembly.

21. The spray gun manifold according to claim 16 wherein each spray gun module includes a module body having an outer surface and wherein a portion of the outer surface of the module body is recessed from an outer surface of at least one adjacent support assembly.

22. The spray gun manifold according to claim 16 wherein each spray gun module includes an external mix type spray nozzle and wherein one of the plurality of fluid conduits in each of the support assemblies communicates atomizing air to the spray gun modules.

23. The spray gun manifold according to claim 16 wherein the spray nozzle of each spray gun module includes an air cap and wherein one of the plurality of fluid conduits in each of the support assemblies communicates fan air to the respective air caps of the spray gun modules.

* * * * *